US006611961B2

(12) United States Patent
Demeur et al.

(10) Patent No.: US 6,611,961 B2
(45) Date of Patent: Sep. 2, 2003

(54) REVERSIBLE MIT FOR DISPOSAL OF WASTE DEBRIS

(76) Inventors: Basil E. Demeur, 1018 N. Forest Ave., Oak Park, IL (US) 60302; Dale N. Padjen, 10820 32nd Ave., Pleasant Prairie, WI (US) 53158

( * ) Notice: Subject to any disclaimer, the term of this patent is extended or adjusted under 35 U.S.C. 154(b) by 0 days.

(21) Appl. No.: 09/741,789

(22) Filed: Dec. 21, 2000

(65) Prior Publication Data

US 2003/0041813 A1 Mar. 6, 2003

(51) Int. Cl.[7] ..... A41D 19/00
(52) U.S. Cl. ..... 2/159; 2/161.6; 15/227
(58) Field of Search ..... 2/16, 20, 158, 2/159, 160, 161.6, 163, 164, 169; 15/227; 294/1.3, 25; 383/4

(56) References Cited

U.S. PATENT DOCUMENTS 4,788,733 A * 12/1988 Lerner ..... 15/104.94
4,845,781 A * 7/1989 Strickland et al. ..... 2/161.6
4,937,881 A * 7/1990 Heise ..... 15/227
5,438,708 A * 8/1995 Jacovitz ..... 15/227
5,568,955 A * 10/1996 Giuliano et al. ..... 294/1.3
5,704,670 A * 1/1998 Surplus ..... 2/159
6,050,726 A 4/2000 Hoerl
6,058,882 A 5/2000 Leutholt
6,116,668 A * 9/2000 Carpol ..... 2/160
6,203,080 B1 * 3/2001 Surplus ..... 2/159
6,237,971 B1 * 5/2001 Ward Gilley ..... 294/1.3
6,298,491 B1 * 10/2001 Blustin et al. ..... 2/161.6

* cited by examiner

*Primary Examiner*—Gary L. Welch
(74) *Attorney, Agent, or Firm*—Basil E. Demeur

(57) ABSTRACT

A mit designed to contemporaneously retrieve and store waste debris for ultimate disposal. The mit is divided into a hand portion and a heel portion that are integrated along a flared portion. The hand portion consists of finger sections that correspond to each of the finger tips of a hand. The hand portion flares inwardly toward the heel portion which then flares outwardly, in a direction opposite the finger sections, to terminate in a base. The mit is used to collect or retrieve waste debris and is then reversed into a tieable bag to secure the waste debris for ultimate disposal. Located at the base are two ties to secure the waste debris within the resulting bag that is formed from the reversibility of the mit.

12 Claims, 2 Drawing Sheets

REVERSIBLE MIT FOR DISPOSAL OF WASTE DEBRIS

I. FIELD OF THE INVENTION

The present invention relates to mits and, more particularly, to a self-contained mit that is used to gather waste debris, after which, the mit is reversable to form a tieable bag that is capable of securing the gathered waste debris for proper disposal.

II. DESCRIPTION OF THE PRIOR ART

Hand held wearing apparel such as mits are typically used to retrieve and dispose of waste debris. With respect to animals or pets, this wearing apparel is designed to be worn on the hand of the user for retrieval of the animal feces or, generally, waste debris. The wearing apparel is then converted into a bag or container that is used to secure the waste debris for later disposal.

A significant problem with the wearing apparel for the disposal of this waste debris, especially owners who publicly walk their animals, is that the wearing apparel is inherently ineffective for the retrieval or collection of the animal feces or waste debris.

For example, U.S. Pat. No. 6,058,882 to Leutholt entitled "Petpotty-Pickup" discloses an apparatus for the retrieval and disposal of domesticated house animal's waste. The apparatus consists of a mitten with a closed top and an open bottom, a thumb portion, and a draw strap situated around the circumference of the bottom of the mitten. In use, the hand is inserted into the open bottom of the mitten with the four main fingers placed in the large portion of the mitten and the thumb placed in the thumb portion. To collect the animal feces or waste, the user gently encloses the hand around the feces to form a closed fist around the feces. After which, the user pulls the open bottom of the apparatus over the mitten to invert the apparatus to hold the feces and permit the hand to be removed from the mitten. The draw strap is then tightened to secure and close the feces within the apparatus.

This patent, however, has several inherent shortcomings. First, the combination of the flat mitten portion and the thumb portion do not permit either a complete or easy retrieval or collection of the animal feces. In fact, when the mitten portion and the thumb portion are closed around the animal feces, much of the animal feces is permitted to escape due to the flat portion of the mit not being able to contain the animal feces or prevent the collected animal feces from escaping. As a result, the user is forced to use several apparatus or mittens to completely collect and dispose of all the animal feces, a requirement which is unnecessary, wasteful, and time consuming. Second, the width of the mitten portion and the thumb portion are greater than the width of the bottom of the apparatus such that, upon the apparatus being inverted, the enclosed fist of the mitten portion and the thumb portion that contains the animal feces is required to be clinched tighter to accommodate the smaller width of the bottom of the apparatus. Thus, more of the animal feces will be forced to escape from the enclosed, clinched fist prior to the apparatus being inverted. As a result, the user is again forced to use several apparatus or mittens to completely collect and dispose of all the animal feces, a requirement which is unnecessary, wasteful, and time consuming.

The retrieval and collection problems of animal feces by the mitten apparatus are solved by U.S. Pat. No. 6,050,726 to Hoerl entitled "Glove Bag". This patent discloses a container which consists of a storage space with a glove on one end and an open mouth on the other. In use, the hand is inserted into the open mouth and through the storage space into a glove that contains five finger sections to completely secure each individual finger of the hand. The user collects the desired materials with the glove and, then, inverts the container such that user's hand becomes removable from the glove with the collected materials remaining within the storage space. A drawstring is then wrapped about the open mouth to seal the container and the collected materials for disposal.

An inherent shortcoming of this patent is that the five finger glove, while solving the disadvantages of the mitten, does not retain the advantages of the mitten. Animal feces have several forms: solid, firm but compressible, and liquid. Except for the solid form, the five finger glove permits the other two forms of animal feces to escape between each of the fingers during collection. As a result, the user is forced to use several containers or gloves to completely collect and dispose of all the animal feces, a requirement which is also unnecessary, wasteful, and time consuming. Another inherent shortcoming is that, upon the container being inverted, the collected animal feces, if not in the solid form, will deposit into each of the individual five fingers of the glove and form part of the storage space. Since the individual fingers are the actual size of fingers, large deposits may be made from the collection. As the individual fingers are not as strong as the storage space as a whole, each finger of the container is susceptible to breaking and, thereby, not permitting the proper disposal of the animal feces but displacing it instead in unwanted places.

The problems of the wearing apparel are, however, solved by the present invention: a unique self-contained reversible mit that effectively retrieves waste debris with a finger tip combination and then, using a flared portion, properly transforms the mit into a tieable storage bag for ultimate disposal.

Thus, there is a need and there has never been disclosed a unique self-contained and reversible mit to effectively retrieve and dispose of waste debris.

III. OBJECTS OF THE INVENTION

It is the primary object of the present invention to provide a self-contained mit to effectively retrieve the waste debris.

Another object of the present invention is to provide a mit that is reversible to effectively store and dispose of the collected waste debris. A related object of the invention is to provide a mit that enables transformation from a retrievable mit into a storage bag. Still another related object of the invention is to provide a mit which enables the waste debris to be properly secured within the storage bag.

Another object of the present invention is to provide a mit that is biodegradable along with the waste debris.

Another object of the invention is to provide a mit that is economical to manufacture and available for practical use by the user.

Still another object of the invention is to provide a mit that is safe and easy to use.

Other objects of the present invention will become more apparent to persons having ordinary skill in the art to which the present invention pertains from the following description taken in conjunction with the accompanying drawings.

IV. SUMMARY OF THE INVENTION

The present invention is a mit designed to contemporaneously retrieve and store waste debris for ultimate disposal.

The mit is divided into a hand portion and a heel portion that are integrated along a flared portion. The hand portion consists of finger sections that correspond to each of the finger tips of a hand. The hand portion flares inwardly toward the heel portion which then flares outwardly, in a direction opposite the finger sections, to terminate in a base. Located at the base are two ties to secure the waste debris within the resulting bag that is formed from the reversibility of the mit.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
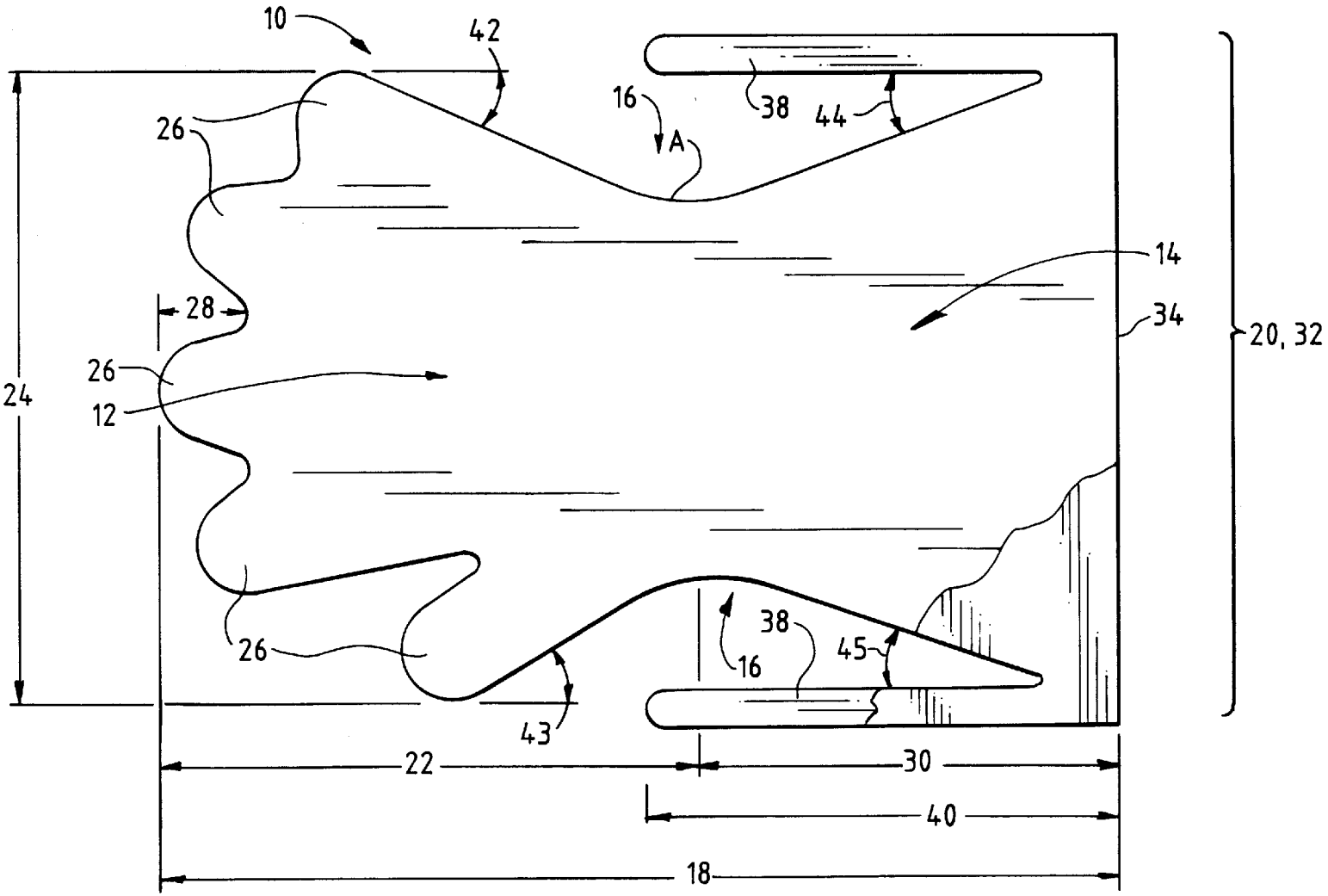
FIG. 1 is a plan elevational view of the inventive device and, in particular, illustrating the hand portion and the heel portion of the mit integrated along the flared portion.

Turning first to FIG. 1, there is illustrated a mit 10 having a hand portion 12 and a heel portion 14 that are integrally formed together along a flared portion 16. The mit 10 has a mit length 18 and a mit width 20. The mit 10 is made of a pliable material. Preferably, the pliable material is of sufficient strength and tear resistance to secure for disposal the animal feces or waste debris that is collected. The pliable material may be transparent or, alternatively, displayed with any suitable color or design. The benefit of designing the mit 10 with any suitable color or design is that the color or design will hide the user's hand and, thereby, prevent the user from actually viewing the hand that is collecting the animal feces or waste debris.

The hand portion 12 has a hand length 22 and a hand width 24. Preferably, the hand length 22 and the hand width 24 combine to form a hand portion 12 that is large enough to accommodate any size hand of an adult or child. The hand portion 12 has finger sections 26. In the preferred embodiment, the mit 10 has five finger sections 26 in the hand portion 12 with each finger section 26 accommodating each of the fingers of a person's hand. Each of the finger sections 26 have a finger length 28. In the preferred embodiment, the finger length 28 of each of the finger sections 26 is smaller than the length of each of the corresponding fingers of a person's hand. In this manner, due to the smaller finger length 28 of each of the finger sections 26, only the tips or a small portion of each of the fingers of a person's hand is accommodated by the corresponding finger sections 26. In the preferred embodiment, the finger length 28 of each of the finger sections 26 is less than the actual length of the fingers of the person's hand. The hand portion 12 with the finger sections 26 is also equally able to accommodate either the left hand or the right hand or the person, as desired.

The heel portion 14, situated at the opposite end of the hand portion 12 of the mit 10, has a heel length 30 and a heel width 32. The heel width 32 is approximately equal to the mit width 20 and, for the reasons explained in further detail below, is slightly larger than the hand width 24. Preferably, the heel length 30 and the heel width 32 combine to form a heel portion 14 that is large enough to accommodate the wrist and lower forearm of any size hand and arm of an adult or child.

The heel portion 14 has a base 34. The base 34 has a base opening 36 (FIG. 2) to permit entry of the user's hand for access through the heel portion 14 to the hand portion 12. Adjacent to the heel portion 14 and extending outwardly from the base 34 toward the hand portion 12 are ties 38. The ties 38 are integrally molded to the mit 10 and have a tie length 40. Preferably, as explained in further detail below, the tie length 40 is slightly larger than the heel length 30. In an alternate embodiment, the tie length 40 may be smaller than the heel length 30.

The integration of the hand portion 12 to the heel portion 14 is along the flared portion 16. The flared portion 16 is a convex curvature along the outside exterior of the mit 10 from the finger sections 26 of the hand portion 12 to the base 34 of the heel portion 14. The flared portion 16 flares inwardly from the finger sections 26 of the hand portion 12 at a inward flare angle 42 and 43 to the bottom of the convex curvature at Point A. Preferably, the inward flare angle 42 is approximately 20 degrees and the inward flare angle 43 is approximately 30 degrees. The inward flare angle 42 and the inward flare angle 43 each having a variation from 10 degrees to 35 degrees. From Point A to the base 34 of the heel portion 14 the flared portion 16 flares outwardly at an outward flare angle 44 and 45. Preferably, the outward flare angle 44 is approximately 20 degrees and the outward flare angle 45 is approximately 15 degrees. The outward flare angle 44 and the outward flare angle 45 each angle having a variation from 10 degrees to 35 degrees. In an alternate embodiment, it has been found that the mit 10 works for its intended purpose when the inward flare angle 42, the inward flare angle 43, the outward flare angle 44, and outward flare angle 45 are zero degrees; however, the flared portion 16 as described above is preferred to provide for a more efficient and versatile reversible mit 10. Preferably, the inward flare angle 42 is substantially equal to the outward flare angle 44 and the inward flare angle 43 is substantially twice the outward flare angle 45.

Figure 2:
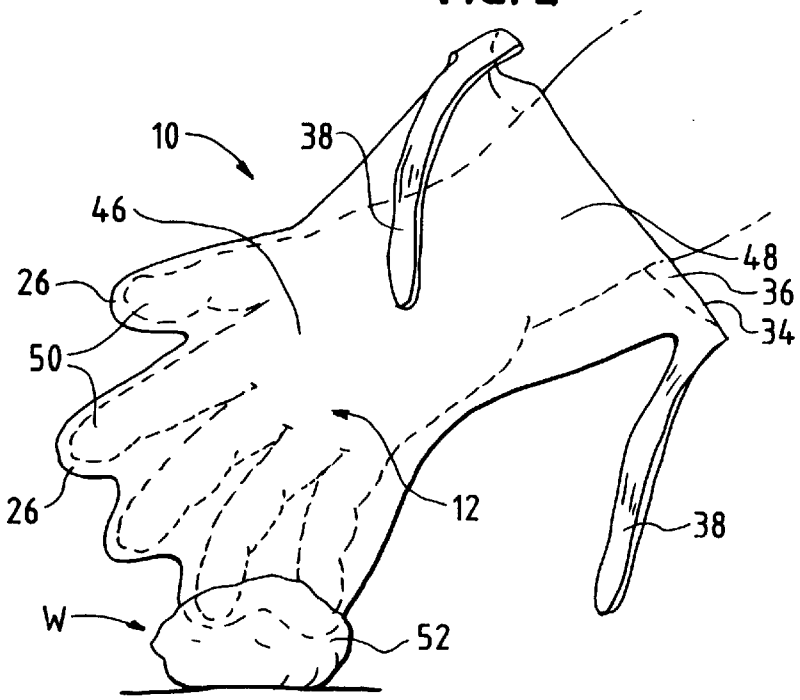
FIG. 2 is a side perspective view of the mit in use prior to the retrieval or collection of the waste debris.
Figure 3:
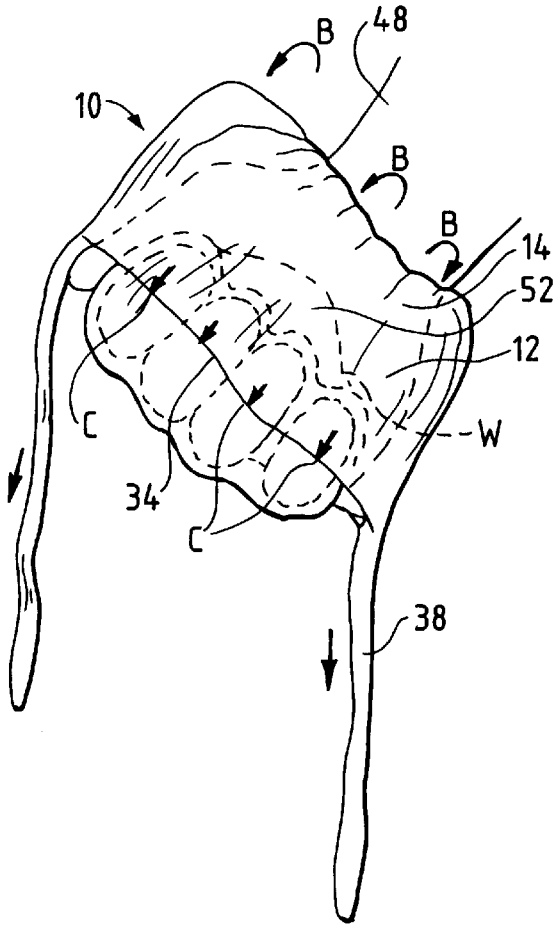
FIG. 3 is a side perspective view of the mit, after retrieval or collection of the waste debris, and being transformed into a securable bag to contain the waste debris.
Figure 4:
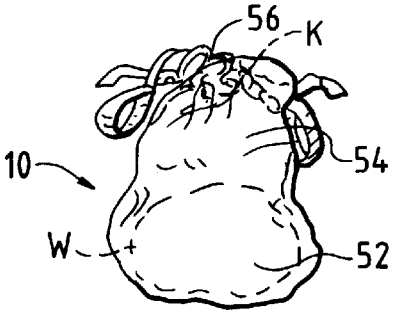
FIG. 4 is a side elevational view of the bag as secured to contain the waste debris prior to the ultimate disposal.

FIGS. 2, 3, and 4, combine to illustrate the use of the mit 10. Turning to FIG. 2, a hand 46 and a forearm 48 are inserted through the base opening 36 of the base 34 of the heel portion 14 of the mit 10 until each of the finger tips 50 are received by the corresponding finger sections 26 of the hand portion 12. The forearm 48 remains primarily within the heel portion 14 of the mit 10. Once the finger tips 50, the hand 46, and the forearm 48 are in proper position within the mit 10, the user, as illustrated, is ready to collect or retrieve waste debris 52, also designated by reference W. The waste debris 52 includes but is not limited to animal feces. The ties 38 remain on the outside of the mit 10 and, with the tie length 40, hang freely without causing an interference or overlap with the hand portion 12 or the finger sections 26. During the collection or retrieval, the finger sections 26 permit the user the ability to control the mit 10 and form a closed fist while maintaining the maximum surface area of the hand portion 12 for the proper and efficient collection or retrieval of the waste debris 52 and as further illustrated and described in FIG. 3.

In FIG. 3, the waste debris 52 is completely collected or retrieved by the user into the mit 10, specifically, within the hand portion 12. Due to the finger length 28 of the finger sections 26 and the maximum surface area of the hand portion 12, the waste debris 52 is not permitted to escape between the finger sections 26 or from the hand portion 12 once collected or retrieved into the mit 10 by the user.

After the waste debris 52 is collected or retrieved into the mit 10 by the user, the mit 10, being reversible, is then converted into a bag 54 (FIG. 4) to secure the waste debris 52 for ultimate disposal. Referring still to FIG. 3, the user grabs the base 34 of the heel portion 14 and rotates the complete circumference of the base 34 of the heel portion 14 outwardly, down, and away from the forearm 48 of the user as illustrated by Arrows B. The user then pulls the heel portion 14 over the hand portion 12 of the mit 10 as illustrated by Arrows C. Even after the mit 10 is reversed or transformed into a bag 54, the ties 38 remain on the outside of the mit 10 and hang freely without causing an interference or overlap with the heel portion 14, the hand portion 12, or the mit 10.

This reversibility of the mit 10 is effectively accomplished as the base width 20 and the heel width 32 are slightly larger than the hand width 24 such that there is sufficient spacing, as provided by the inward flare angle 42 and the outward flare angle 44 of the flared portion 16, to effectively rotate the complete circumference of the base 34 of the heel portion 14 outwardly, down, and over the hand portion 12, thereby, easily reversing the mit 10 into a bag 54. In the preferred embodiment, it is this designed spacing between the overlapping heel portion 14 of the hand portion 12 that prevents the mit 10 from being torn, ripped, or damaged in any manner during the transformation into the bag 54 which would render the mit 10 useless. The spacing also accommodates any size, large or small, of waste debris 52 that is collected or retrieved into the hand portion 14 of the mit 10 and, thereby, eliminates the need for the user to crush the waste debris 52 to a smaller size to accommodate the reversibility, or the need for the user to limit or reduce the size of the collected or retrieved waste debris 52.

After the mit 10 is reversed into a bag 54 as illustrated in FIG. 4, the user's hand 46 is automatically removed from the mit 10 during the reversal. The waste debris 52 secured within the bag 54 and is formed by the opposite side of the hand portion 12 which is the same side of the hand portion 12 that the waste debris 52 was originally collected or retrieved. In this manner, the mit 10 always acts as a buffer between the user's hand 46 and the waste debris 52 such that the user's hand is never in direct contact with the waste debris 52. The reversed heel portion 14 and the base 34 of the bag 54 remain open to the waste debris 52 until the ties 38 are tied or formed into a knot 56, also designated by reference K to close the base 34 of the heel portion 14 and provide a secured tieable bag 54 for ultimate disposal.

Thus, there has been provided a self-contained, reversible, mit that is used to gather waste debris and form a securable tieable bag for the ultimate disposal of the waste debris. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. An item of wearing apparel intended to be worn on the hand of a user and adapted for retrieving and disposing of waste debris, comprising:

a self-contained mit having a hand portion and a heel portion, and further defining an exterior side and an interior side, the hand portion and the heel portion being formed along opposed flared portions;

the hand portion having a hand width and further defining a plurality of finger sections disposed at one end of the hand portion, the plurality of finger sections each having a finger length for receiving a tip of a corresponding finger of a hand, the finger length of each finger section having a tip length less than the actual length of the corresponding finger of the hand;

the heel portion having a heel width and further defining an open base disposed at one end of the heel portion and opposite the finger sections of the hand portion, the heel width being larger than the hand width;

each of the opposed flared portions tapering inwardly at an inward flare angle from the hand portion to the heel portion and tapering outwardly at an outward flare angle from the heel portion to the base, the inward flare angle being substantially equal to the outward flare angle on one side of the mit and the inward flare angle being substantially equal to twice the outward flare angle on the other side of the mit; and at least one tie being affixed to the base of the heel portion;

whereby a user installs the mit on a hand by inserting the hand into the open base of the mit, through the heel portion, and to the hand portion for the tips of the fingers of the hand being individually received by the corresponding finger sections, the user retrieving waste debris within the hand portion on the exterior side of the mit and then reversing the mit with the interior side of the mit becoming a new exterior side of the mit and the exterior side of the mit holding the waste debris becoming a new interior side of the mit such that the bag may be tied by the at least one tie for securing the waste debris for ultimate disposal.

2. The item of wearing apparel of claim 1 wherein the mit is made of a pliable material.

3. The item of wearing apparel of claim 1 wherein the inward flare angle is between 10 degrees and 35 degrees.

4. The item of wearing apparel of claim 1 wherein the outward flare angle is between 10 degrees and 35 degrees.

5. The item of wearing apparel of claim 1 wherein the inward flare angle is substantially equal to the outward flare angle on one side of the mit and the inward flare angle is larger than the outward flare angle on the other side of the mit.

6. An item of wearing apparel intended to be worn on the hand of a user and adapted for retrieving and disposing of waste debris, comprising:

a mit having a proximal end and a distal end separated by a mit length and further defining a flared portion extending from the proximal end of the mit to the distal end, the flared portion tapering inwardly at an inward flare angle from the proximal end to a convex point and tapering outwardly at an outward flare angle from the convex point to the distal end, the inward flare angle being substantially equal to the outward flare angle on one side of the mit and the inward flare angle being substantially equal to twice the outward flare angle on the other side of the mit;

a plurality of finger sections at the proximal end, the plurality of finger sections each having a finger length for receiving a tip of a corresponding finger of a hand, the finger length of each finger section having a tip length less than the actual length of the finger of the hand, the finger sections defining a hand width;

an open base at the distal end, the open base having a width that is larger than the hand width;

at least one tie affixed to the mit at the distal end and adjacent to the base, the tie having a tie length.

7. The item of wearing apparel of claim 6 wherein the mit is made of a pliable material.

8. The item of wearing apparel of claim 6 wherein the inward flare angle is between 10 degrees and 35 degrees.

9. The item of wearing apparel of claim 6 wherein the outward flare angle is between 10 degrees and 35 degrees.

10. The item of wearing apparel of claim 6 wherein the mit has two ties which are located at the distal end and adjacent to the base on opposite sides of the mit.

11. A method for using an item of wearing apparel to retrieve and dispose of waste debris, comprising the steps of:

providing a self-contained mit having a hand portion and a heel portion, and further defining an exterior side and an interior side, the hand portion and the heel portion being formed along a flared portion; the hand portion having a hand width and further defining a plurality of finger sections disposed at one end of the hand portion, the plurality of finger sections each having a finger length for receiving a tip of a corresponding finger of a hand, the finger length of each finger section having a tip length less than the actual length of the finger of the hand; the heel portion having a heel width and further defining an open base disposed at one end of the heel portion located opposite the finger sections of the hand portion, the heel width being larger than the hand width; the flared portion tapering inwardly at an inward flare angle from the hand portion to the heel portion and tapering outwardly at an outward flare angle from the heel portion to the base; the inward flare angle being substantially equal to the outward flare angle on one side of the mit and the inward flare angle being substantially equal to twice the outward flare angle on the other side of the mit: and at least one tie being affixed to the base of the heel portion;

inserting a hand into the open base of the of the mit, the hand being received through the heel portion and into the hand portion such that the tips of the fingers of the hand are individually received by the corresponding finger sections;

retrieving the waste debris within the hand portion on the exterior side of the mit;

reversing the mit into a bag such that the exterior side of the mit holding the waste debris becoming a new interior side of the bag to hold the waste debris and the interior side of the mit becoming a new exterior side of the bag;

removing the hand from the bag;

securing the bag using the at least one tie; and disposing of the bag containing the waste debris.

12. A method for using an item of wearing apparel to retrieve and dispose of waste debris, comprising the steps of:

providing a mit having a proximal end and a distal end separated by a mit length and further defining a flared portion extending from the proximal end of the mit to the distal end, the flared portion tapering inwardly at an inward flare angle from the proximal end to a convex point and tapering outwardly at an outward flare angle from the convex point to the distal end; the inward flare angle being substantially equal to the outward flare angle on one side of the mit and the inward flare angle being substantially equal to twice the outward flare angle on the other side of the mit; a plurality of finger sections at the proximal end, the plurality of finger sections each having a finger length for receiving a tip of a corresponding finger of a hand, the finger length of each finger section having a tip length less than the actual length of the finger of the hand, the finger sections defining a hand width; an open base at the distal end, the open base having a width that is larger than the hand width; at least one tie affixed to the mit at the distal end and adjacent to the base, the tie having a tie length;

inserting a hand into the open base of the of the mit, the hand being received into the mit such that the tips of the fingers of the hand are individually received by the corresponding finger sections;

retrieving the waste debris between the mit and finger sections at the proximal end of the mit;

reversing the mit into a bag such that the distal end of the mit is folded outwardly and over the proximal end of the mit that retrieved the waste debris with the proximal end forming a bottom of the bag that contains the waste debris and the distal end forming a top of the bag;

removing the hand from the bag;

securing the top of the bag using the at least one tie; and disposing of the bag containing the waste debris.

* * * * *